US009113506B2

(12) United States Patent
Lee et al.

(10) Patent No.: US 9,113,506 B2
(45) Date of Patent: Aug. 18, 2015

(54) CIRCUIT WITH ADJUSTABLE PHASE DELAY AND A FEEDBACK VOLTAGE AND METHOD FOR ADJUSTING PHASE DELAY AND A FEEDBACK VOLTAGE

(71) Applicant: Leadtrend Technology Corp., Hsin-Chu (TW)

(72) Inventors: Hung-Ching Lee, Hsin-Chu (TW); Yeu-Torng Yau, Hsin-Chu (TW); Wei-Chi Huang, Hsin-Chu (TW)

(73) Assignee: Leadtrend Technology Corp., Science-Based Industrial Park, Hsin-Chu (TW)

( * ) Notice: Subject to any disclaimer, the term of this patent is extended or adjusted under 35 U.S.C. 154(b) by 276 days.

(21) Appl. No.: 13/831,027

(22) Filed: Mar. 14, 2013

(65) Prior Publication Data

US 2014/0042924 A1 Feb. 13, 2014

(30) Foreign Application Priority Data

Aug. 8, 2012 (TW) ..... 101128548 A

(51) Int. Cl.

| | |
|---|---|
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.

CPC ..... *H05B 37/02* (2013.01); *H05B 33/0803* (2013.01)

(58) Field of Classification Search

USPC ..... 315/210–226

See application file for complete search history.

(56) References Cited

U.S. PATENT DOCUMENTS

| | | | | |
|---|---|---|---|---|
| 8,018,171 | B1 * | 9/2011 | Melanson et al. | 315/194 |
| 8,975,831 | B1 * | 3/2015 | Szolusha et al. | 315/291 |
| 2003/0090219 | A1 * | 5/2003 | Kazanov et al. | 315/291 |
| 2004/0012346 | A1 * | 1/2004 | Green et al. | 315/291 |
| 2005/0077840 | A1 * | 4/2005 | Kazanov et al. | 315/294 |
| 2009/0167398 | A1 | 7/2009 | Oishi | |
| 2011/0109249 | A1 * | 5/2011 | Liu et al. | 315/307 |

* cited by examiner

*Primary Examiner* — Brandon S Cole

(74) *Attorney, Agent, or Firm* — Winston Hsu; Scott Margo

(57) ABSTRACT

A circuit with adjustable phase delay and a feedback voltage includes a delay setting unit and a phase delay signal generator. The delay setting unit generates a delay time according to an external resistor. The phase delay signal generator includes a plurality of phase delay units. Each phase delay unit includes an edge trigger subunit and a signal generation subunit. The edge trigger subunit receives an input signal, and generates a positive edge trigger signal and a negative edge trigger signal according to a positive edge and a negative edge of the input signal, respectively. The signal generation subunit generates and outputs a phase delay signal according to the positive edge trigger signal, the negative edge trigger signal, and the delay time. The phase delay signal lags the input signal for the delay time.

19 Claims, 6 Drawing Sheets

CIRCUIT WITH ADJUSTABLE PHASE DELAY AND A FEEDBACK VOLTAGE AND METHOD FOR ADJUSTING PHASE DELAY AND A FEEDBACK VOLTAGE

BACKGROUND OF THE INVENTION

1. Field of the Invention

The present invention relates to a circuit with adjustable phase delay and a feedback voltage and a method for adjustable phase delay and a feedback voltage, and particularly to a circuit and a method that can utilize a delay setting unit, a phase delay signal generator, and a sample and hold unit to generate adjustable phase delay and a stable feedback voltage.

2. Description of the Prior Art

Please refer to FIG. 1 and FIG. 2. FIG. 1 is a diagram illustrating a thin film transistor liquid crystal display (TFT-LCD) generating ghost shadows due to long liquid crystal reaction time, and FIG. 2 is a diagram illustrating the thin film transistor liquid crystal display utilizing a scanning backlight to solve the ghost shadows due to the long liquid crystal reaction time. As shown in FIG. 1, a viewer can view ghost shadows at an interval T because the liquid crystal reaction time is longer and a backlight BL is continuously turned on when liquid crystals of the thin film transistor liquid crystal display are changed from gray level 0 to gray level 255, where VSYNC is a vertical synchronization signal of the thin film transistor liquid crystal display. Meanwhile, the thin film transistor liquid crystal display exhibits a gray color. As shown in FIG. 2, because a backlight BL of the scanning backlight is turned on according to the vertical synchronization signal VSYNC of the thin film transistor liquid crystal display, the viewer can not view the ghost shadows at the interval T because the backlight BL is not turned on when the liquid crystals of the thin film transistor liquid crystal display are changed from the gray level 0 to the gray level 255 (at the interval T). That is to say, the scanning backlight has phase delay to respond liquid crystal rotation time of the thin film transistor liquid crystal display. Thus, the scanning backlight not only can solve the ghost shadows of the thin film transistor liquid crystal display, but can also solve crosstalk between left eye images and right eye images of three-dimensional images when the thin film transistor liquid crystal display displays the three-dimensional images.

In the prior art, because a system needs to provide a plurality of pulse width modulation signals to the scanning backlight to achieve the phase delay, the system has a more complicated circuit layout and higher cost. In another prior art, because a system utilizes a microprocessor to control the phase delay in a digital method, the system has additional cost of the microprocessor. Thus, the above mentioned prior arts not only increase cost of the system, but also increase complexity of the circuit layout of the system, so the above mentioned prior arts are not the best choices for a user.

SUMMARY OF THE INVENTION

An embodiment provides a circuit with adjustable phase delay and a feedback voltage. The circuit includes a delay setting unit and a phase delay signal generator. The delay setting unit is used for coupling to an external resistor, where the delay setting unit generates a delay time according to the external resistor. The phase delay signal generator is coupled to the delay setting unit and includes a plurality of phase delay units, where each phase delay unit corresponds to a lighting module, and each phase delay unit includes an edge trigger subunit and a signal generation subunit. The edge trigger subunit is used for receiving an input signal, and generating a positive edge trigger signal and a negative edge trigger signal according to a positive edge and a negative edge of the input signal, respectively. The signal generation subunit is coupled to the edge trigger subunit for generating and outputting a phase delay signal according to the positive edge trigger signal, the negative edge trigger signal, and the delay time, wherein the phase delay signal lags the input signal for the delay time.

Another embodiment provides a method for adjustable phase delay and a feedback voltage, where a circuit with the adjustable phase delay and the feedback voltage includes a delay setting unit and a phase delay signal generator, and the phase delay signal generator includes a plurality of phase delay units, where each phase delay unit corresponds to a lighting module and includes an edge trigger subunit and a signal generation subunit. The method includes the edge trigger subunit receiving an input signal, and generating a positive edge trigger signal and a negative edge trigger signal according to a positive edge and a negative edge of the input signal, respectively; the delay setting unit generating a delay time according to an external resistor; and the signal generation subunit generating and outputting a phase delay signal according to the positive edge trigger signal, the negative edge trigger signal, and the delay time; where the phase delay signal lags the input signal for the delay time.

The present invention provides a circuit with adjustable phase delay and a feedback voltage and a method for adjustable phase delay and a feedback voltage. The circuit and the method utilize a delay setting unit to generate a delay time according to an external resistor. Then, a phase delay signal generator can generate phase delay signals corresponding to a plurality of lighting modules according to the delay time and a lighting module dimming signal. In addition, a sample voltage generated by a sample and hold unit can overcome variation of a feedback voltage caused by a minimum voltage selection unit due to different number of turning-on lighting modules of the plurality of lighting modules and different number of the plurality of lighting modules to make a lighting module driving circuit be capable of providing a proper output voltage to the plurality of lighting modules. Therefore, the present has advantages as follows: first, because the present invention can make the lighting module driving circuit be capable of providing the proper output voltage to the plurality of lighting modules, the plurality of lighting modules do not exhibit flickers and luminance variation when the plurality of lighting modules are dimmed; second, because the delay setting unit generates the delay time according to the external resistor, a user can adjust the delay time according to a practical requirement (e.g. reaction time of a thin film transistor liquid crystal display panel); and third, because the phase delay signal generator can generate the phase delay signals corresponding to the plurality of lighting modules according to the delay time and the lighting module dimming signal, the present invention does not need a system to provide a plurality of lighting module dimming signals, and not also need a microprocessor, resulting in the present invention having lower cost. Therefore, the present invention can be applied to backlight modules, lighting modules of lighting equipments, and other light sources needing phase delay.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
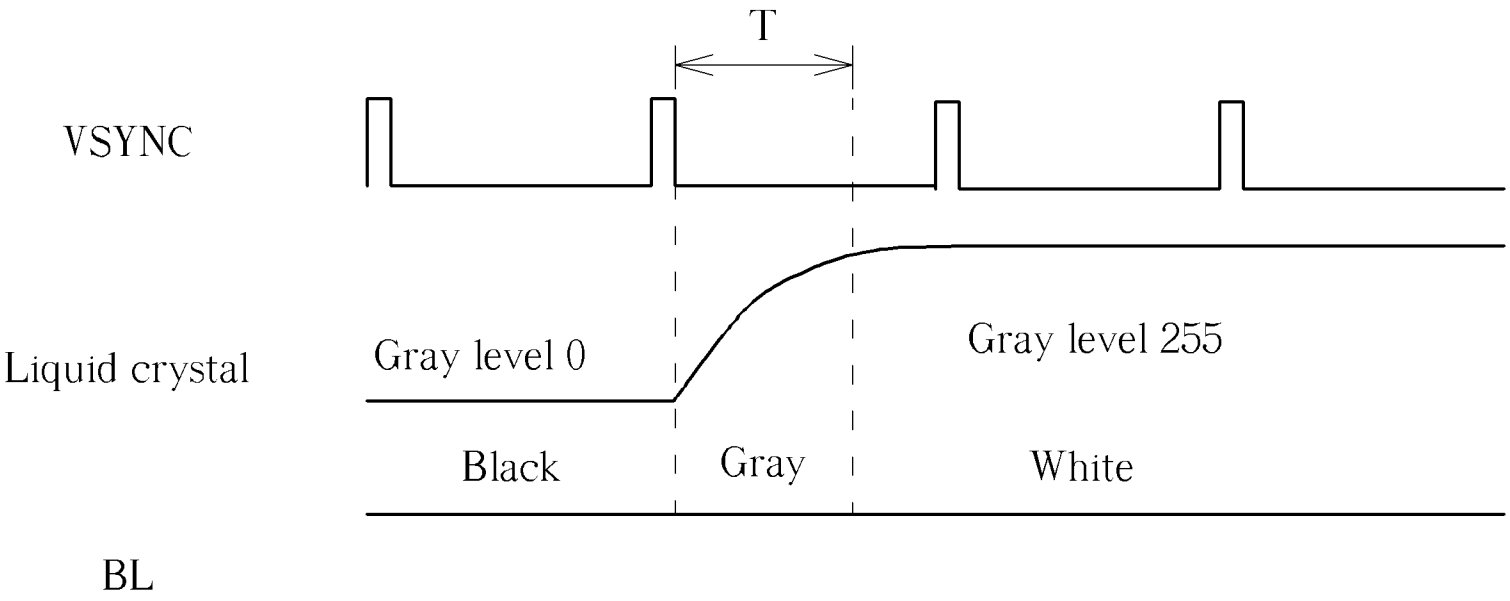
FIG. 1 PRIOR ART
FIG. 1 is a diagram illustrating a thin film transistor liquid crystal display generating ghost shadows due to long liquid crystal reaction time.
Figure 2:
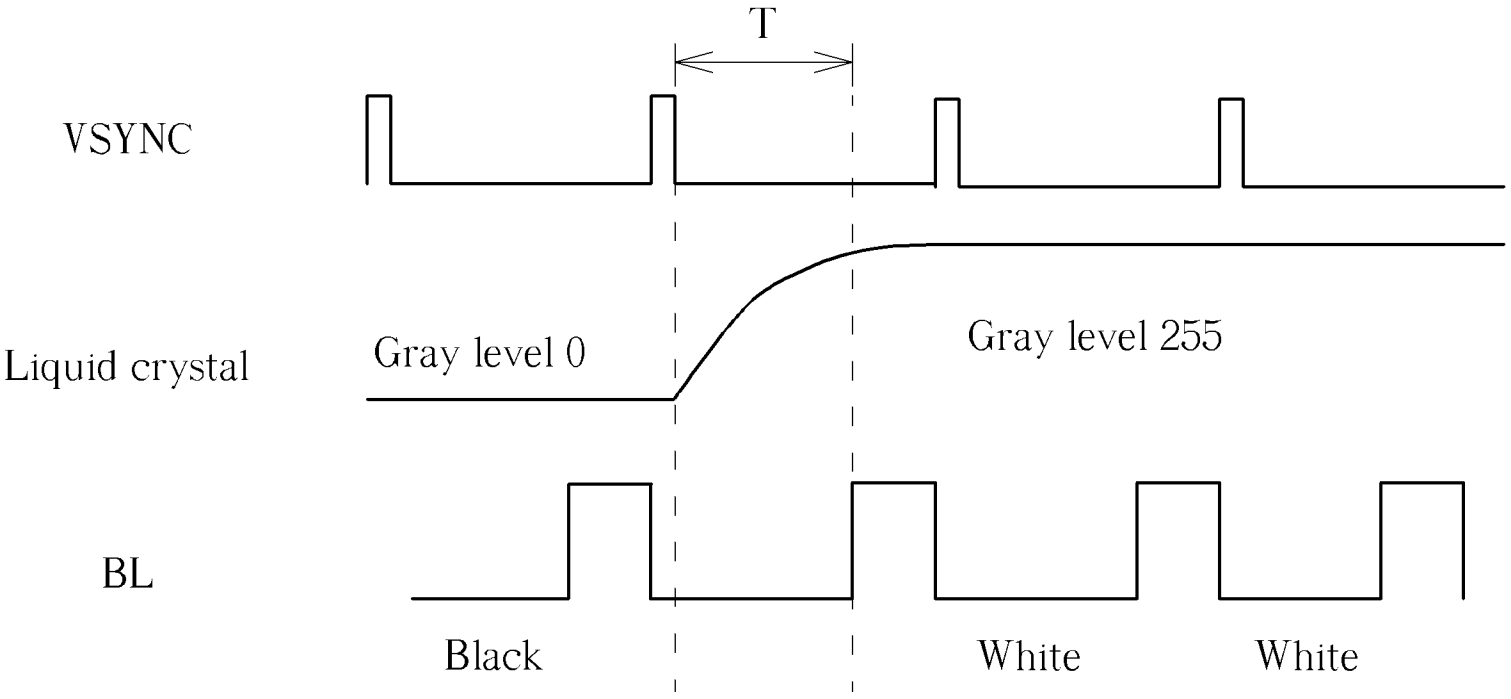
FIG. 2 PRIOR ART
FIG. 2 is a diagram illustrating the thin film transistor liquid crystal display utilizing a scanning backlight to solve the ghost shadows due to the long liquid crystal reaction time.
Figure 3:
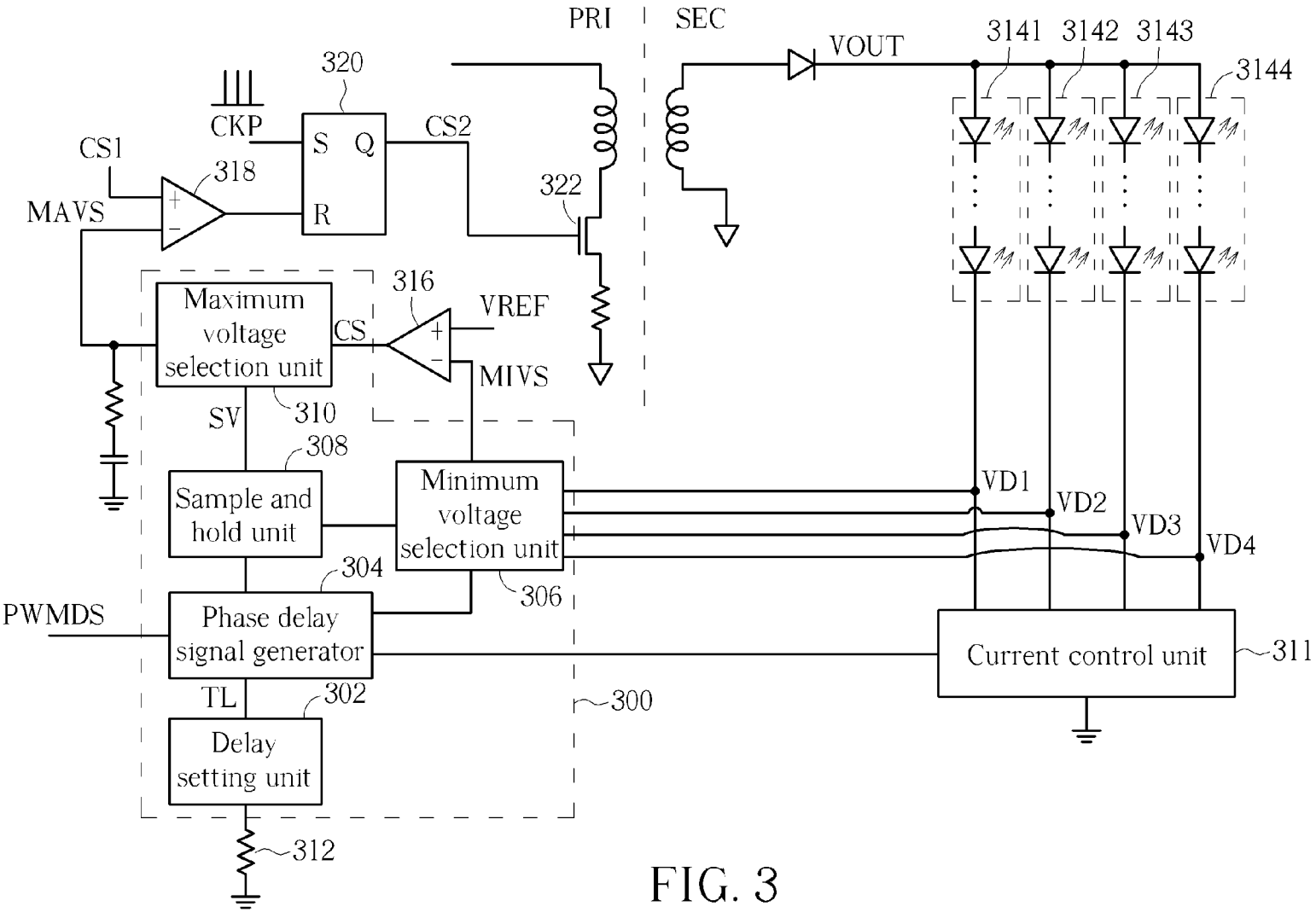
FIG. 3 is a diagram illustrating a circuit with adjustable phase delay and a feedback voltage according to an embodiment.

Please refer to FIG. 3. FIG. 3 is a diagram illustrating a circuit 300 with adjustable phase delay and a feedback voltage according to an embodiment. The circuit 300 includes a delay setting unit 302, a phase delay signal generator 304, a minimum voltage selection unit 306, a sample and hold unit 308, and a maximum voltage selection unit 310, where the maximum voltage selection unit 310, the sample and hold unit 308, the minimum voltage selection unit 306, the delay setting unit 302, and the phase delay signal generator 304 are formed on a monolithic integrated circuit chip. But, the present invention is not limited to the maximum voltage selection unit 310, the sample and hold unit 308, the minimum voltage selection unit 306, the delay setting unit 302, and the phase delay signal generator 304 being formed on the monolithic integrated circuit chip. That is to say, the maximum voltage selection unit 310, the sample and hold unit 308, the minimum voltage selection unit 306, the delay setting unit 302, and the phase delay signal generator 304 can be also composed of discrete components. As shown in FIG. 3, the delay setting unit 302 is used for coupling to an external resistor 312, where the delay setting unit 302 generates a delay time TL according to the external resistor 312. That is to say, the delay time TL can be varied with a resistance of the external resistor 312. The phase delay signal generator 304 is coupled to the delay setting unit 302 and includes a plurality of phase delay units (e.g. 4 phase delay units 3041-3044), where each phase delay unit corresponds to a lighting module (e.g. a light-emitting diode chain), and includes an edge trigger subunit and a signal generation subunit. But, the present invention is not limited to the phase delay signal generator 304 including the 4 phase delay units 3041-3044.

Figure 4:
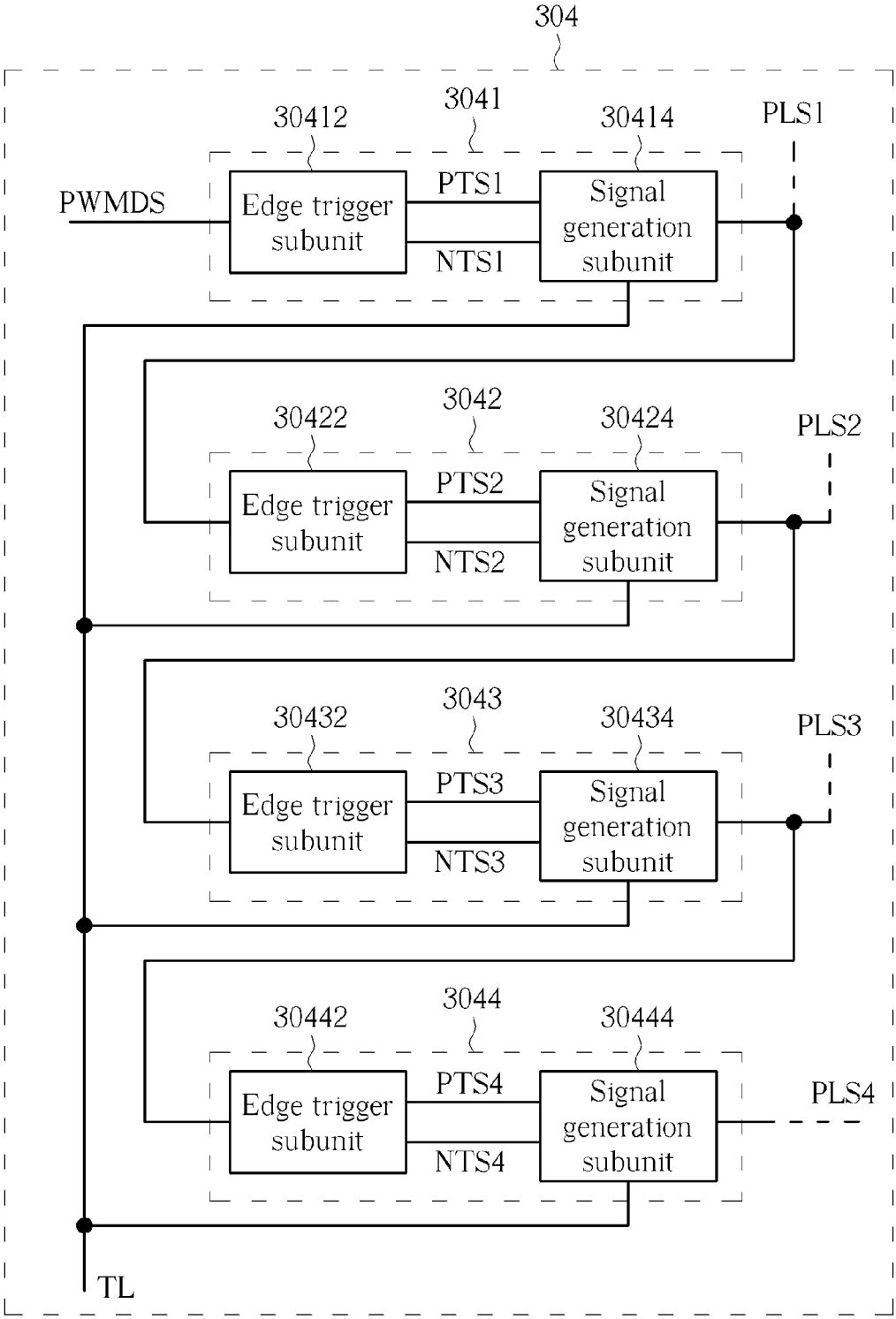
FIG. 4 is a diagram illustrating the phase delay signal generator.

Please refer to FIG. 4. FIG. 4 is a diagram illustrating the phase delay signal generator 304. As shown in FIG. 4, the phase delay unit 3041 corresponds to a lighting module 3141, and includes an edge trigger subunit 30412 and a signal generation subunit 30414. The edge trigger subunit 30412 is used for receiving an external lighting module dimming signal PWMDS, and generates a positive edge trigger signal PTS1 and a negative edge trigger signal NTS1 according to a positive edge and a negative edge of the lighting module dimming signal PWMDS, respectively. The signal generation subunit 30414 is coupled to the edge trigger subunit 30412 for generating and outputting a phase delay signal PLS1 according to the positive edge trigger signal PTS1, the negative edge trigger signal NTS1, and the delay time TL. The phase delay unit 3042 corresponds to a lighting module 3142, and includes an edge trigger subunit 30422 and a signal generation subunit 30424. The edge trigger subunit 30422 is used for receiving the phase delay signal PLS1, and generating a positive edge trigger signal PTS2 and a negative edge trigger signal NTS2 according to a positive edge and a negative edge of the phase delay signal PLS1. The signal generation subunit 30424 generates and outputs a phase delay signal PLS2 according to the positive edge trigger signal PTS2, the negative edge trigger signal NTS2, and the delay time TL. The phase delay unit 3043 corresponds to a lighting module 3143, and includes an edge trigger subunit 30432 and a signal generation subunit 30434. The edge trigger subunit 30432 is used for receiving the phase delay signal PLS2, and generating a positive edge trigger signal PTS3 and a negative edge trigger signal NTS3 according to a positive edge and a negative edge of the phase delay signal PLS2. The signal generation subunit 30434 generates and outputs a phase delay signal PLS3 according to the positive edge trigger signal PTS3, the negative edge trigger signal NTS3, and the delay time TL. The phase delay unit 3044 corresponds to a lighting module 3144, and includes an edge trigger subunit 30442 and a signal generation subunit 30444. The edge trigger subunit 30442 is used for receiving the phase delay signal PLS3, and generating a positive edge trigger signal PTS4 and a negative edge trigger signal NTS4 according to a positive edge and a negative edge of the phase delay signal PLS3. The signal generation subunit 30444 generates and outputs a phase delay signal PLS4 according to the positive edge trigger signal PTS4, the negative edge trigger signal NTS4, and the delay time TL. In addition, the lighting module dimming signal PWMDS, the phase delay signal PLS1, the phase delay signal PLS2, the phase delay signal PLS3, the phase delay signal PLS4 are pulse width modulation signals, and have the same duty cycle and the same frequency. In addition, in another embodiment of the present invention, the phase delay signal PLS1 is an input signal of the edge trigger subunit 30422, the edge trigger subunit 30432, or the edge trigger subunit 30442. In addition, the phase delay signal PLS1, the phase delay signal PLS2, the phase delay signal PLS3, and the phase delay signal PLS4 are also transmitted to a current control unit 311. Therefore, the current control unit 311 can turn on a current flowing through a corresponding lighting module of the 4 lighting modules 3141-3143 according to the phase delay signal PLS1, the phase delay signal PLS2, the phase delay signal PLS3, and the phase delay signal PLS4.

Figure 5:
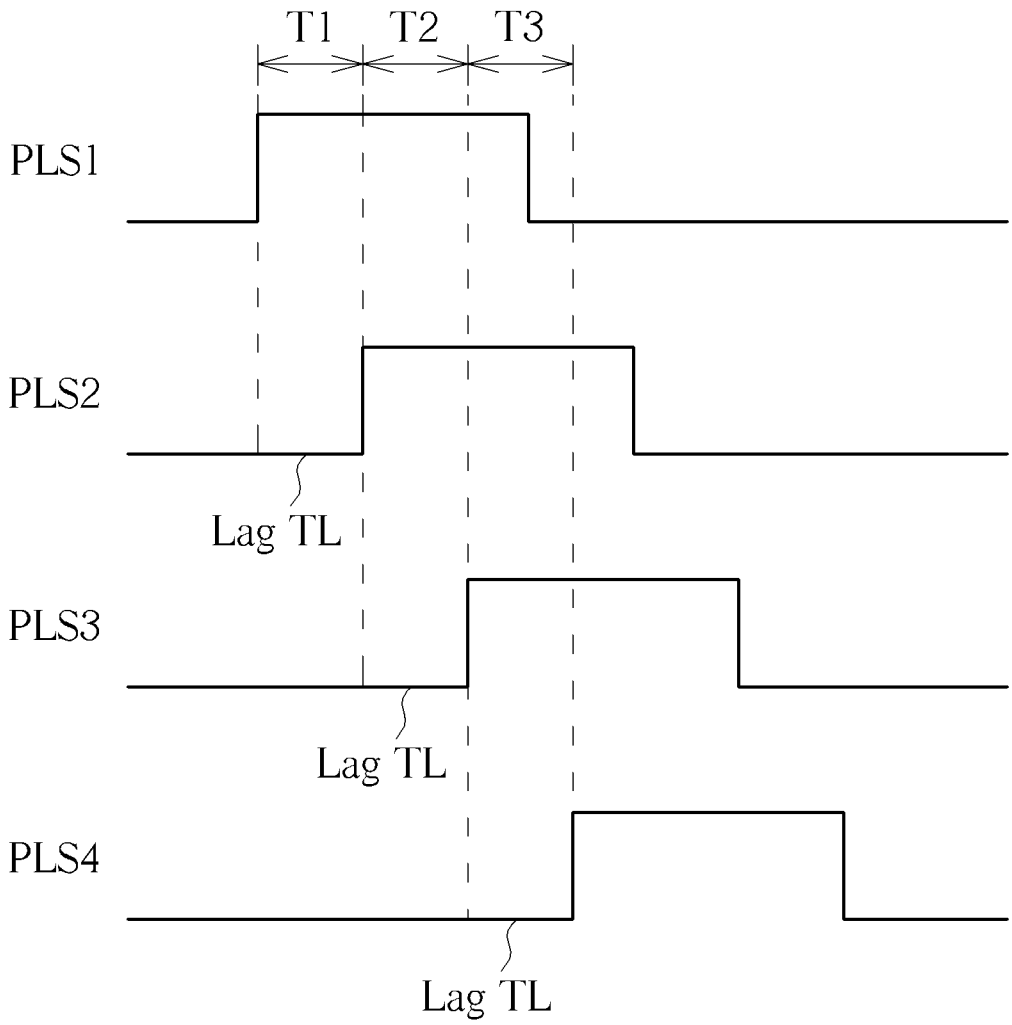
FIG. 5 is a timing diagram illustrating the phase delay signals.

Please refer to FIG. 5. FIG. 5 is a timing diagram illustrating the phase delay signals PLS1, PLS2, PLS3, and PLS4. As shown in FIG. 5, the phase delay signal PLS1 lags the lighting module dimming signal PWMDS for the delay time TL, the phase delay signal PLS2 lags the phase delay signal PLS1 for the delay time TL, the phase delay signal PLS3 for the phase delay signal PLS2 for the delay time TL, and the phase delay signal PLS4 for the phase delay signal PLS3 for the delay time TL.

As shown in FIG. 3, the minimum voltage selection unit 306 is coupled to one terminal of each lighting module of the 4 lighting modules 3141-3144 for generating a minimum voltage signal MIVS to a first comparator 316 according to a voltage of one terminal of each lighting module of the 4 lighting module 3141-3144 (that is, a voltage VD1, a voltage VD2, a voltage VD3, and a voltage VD4) and a positive edge of each phase delay signal, where a voltage of one terminal of each lighting module is determined by an output voltage VOUT of a secondary side SEC of a lighting module driving circuit and voltage drops of a plurality of light-emitting diodes included in each lighting module.

As shown in FIG. 3, the sample and hold unit 308 is coupled to the minimum voltage selection unit 306 and the phase delay signal generator 304 for generating a sample voltage SV according to a combination of a voltage of one terminal of each turning-on lighting module of the 4 lighting module 3141-3144 (that is, a combination of the voltage VD1, the voltage VD2, the voltage VD3, and the voltage VD4) and a positive edge of each phase delay signal. For example, as shown in FIG. 5, during an interval T1, the lighting module 3141 is turned on, so the sample and hold unit 308 generates the sample voltage SV according to the voltage VD1 and a positive edge of the phase delay signal PLS1. During an interval T2, the lighting module 3141 and 3142 are turned on, so the sample and hold unit 308 generates the sample voltage SV according to the voltage VD1, the voltage VD2, and a positive edge of the phase delay signal PLS2. That is to say, the sample voltage SV is a maximum voltage between the voltage VD1 and the voltage VD2. During an interval T3, the lighting module 3141, 3142, and 3143 are turned on, so the sample and hold unit 308 generates the sample voltage SV according to the voltage VD1, the voltage VD2, the voltage VD3, and a positive edge of the phase delay signal PLS3. That is to say, the sample voltage SV is a maximum voltage among the voltage VD1, the voltage VD2, and the voltage VD3.

As shown in FIG. 3, the maximum voltage selection unit 310 is coupled to the sample and hold unit 308 and the first comparator 316. The first comparator 316 compares the minimum voltage signal MIVS and a reference voltage VREF to generate a comparison signal CS. Then, the maximum voltage selection unit 310 generates a maximum voltage signal MAVS according to the sample voltage SV and the comparison signal CS, and transmits the maximum voltage signal MAVS to a second comparator 318. Then, the second comparator 318 and an SR FLIP-FLOP 320 generates a control signal CS2 of a power switch 322 of a primary side PRI of the lighting module driving circuit according to the maximum voltage signal MAVS, a control signal CS1, and a clock pulse CKP, where the control signal CS2 is a pulse width modulation signal.

Figure 6:
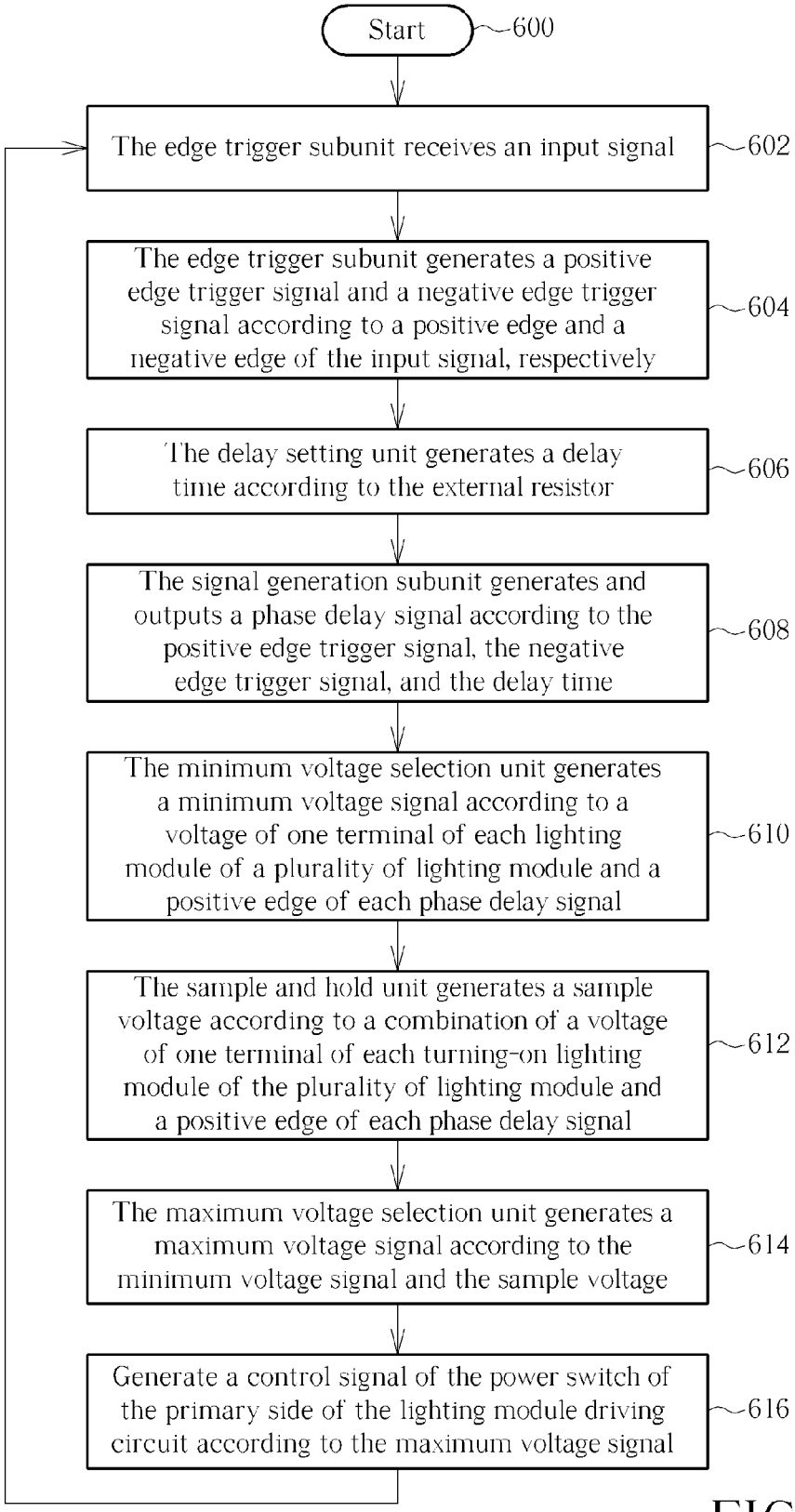
FIG. 6 is a flowchart illustrating a method for adjustable phase delay and a feedback voltage according to another embodiment.

Please refer to FIG. 3, FIG. 4, FIG. 5, and FIG. 6. FIG. 6 is a flowchart illustrating a method for adjustable phase delay and a feedback voltage according to another embodiment. The method in FIG. 6 is illustrated using the circuit 300 in FIG. 3 and the phase delay signal generator 304 in FIG. 4. Detailed steps are as follows:

Step 600: Start.

Step 602: The edge trigger subunit receives an input signal.

Step 604: The edge trigger subunit generates a positive edge trigger signal and a negative edge trigger signal according to a positive edge and a negative edge of the input signal, respectively.

Step 606: The delay setting unit 302 generates a delay time TL according to the external resistor 312.

Step 608: The signal generation subunit generates and outputs a phase delay signal according to the positive edge trigger signal, the negative edge trigger signal, and the delay time TL.

Step 610: The minimum voltage selection unit 306 generates a minimum voltage signal according to a voltage of one terminal of each lighting module of a plurality of lighting module and a positive edge of each phase delay signal.

Step 612: The sample and hold unit 308 generates a sample voltage according to a combination of a voltage of one terminal of each turning-on lighting module of the plurality of lighting module and a positive edge of each phase delay signal.

Step 614: The maximum voltage selection unit 310 generates a maximum voltage signal according to the minimum voltage signal and the sample voltage.

Step 616: Generate a control signal of the power switch of the primary side PRI of the lighting module driving circuit according to the maximum voltage signal; go to Step 602.

In Step 602, the edge trigger subunit 30412 receives an external lighting module dimming signal PWMDS, where the lighting module dimming signal PWMDS is a pulse width modulation signal. In Step 604, the edge trigger subunit 30412 generates a positive edge trigger signal PTS1 and a negative edge trigger signal NTS1 according to a positive edge and a negative edge of the lighting module dimming signal PWMDS. In Step 608, the signal generation subunit 30414 generates and outputs a phase delay signal PLS1 to the edge trigger subunit 30422, the minimum voltage selection unit 306, the sample and hold unit 308, and the current control unit 311 according to the positive edge trigger signal PTS1, the negative edge trigger signal NTS1, and the delay time TL, where the phase delay signal PLS1 and the lighting module dimming signal PWMDS have the same duty cycle and the same frequency. Therefore, the edge trigger subunit 30422, the minimum voltage selection unit 306, the sample and hold unit 308, and the current control unit 311 can execute corresponding operations according to the phase delay signal PLS1, and further descriptions thereof are omitted for simplicity. In Step 610, the minimum voltage selection unit 306 generates a minimum voltage signal MIVS to the first comparator 316 according to a voltage of one terminal of each lighting module of the 4 lighting modules 3141-3144 (that is, a voltage VD1, a voltage VD2, a voltage VD3, and a voltage VD4) and a positive edge of each phase delay signal. In Step 612, the sample and hold unit 308 is coupled to the minimum voltage selection unit 306 and the phase delay signal generator 304 for generating a sample voltage SV according to a combination of a voltage of one terminal of each turning-on lighting module of the 4 lighting module 3141-3144 (meanwhile, because only the lighting module 3141 is turned on, the combination is the voltage VD1) and a positive edge of phase delay signal PLS1. In Step 614, the maximum voltage selection unit 310 generates a maximum voltage signal MAVS according to the minimum voltage signal MVS and the sample voltage SV, and transmits the maximum voltage signal MAVS to the second comparator 318. In Step 616, the second comparator 318 and the SR FLIP-FLOP 320 generates a control signal CS2 of the power switch 322 of the primary side PRI of the lighting module driving circuit according to the maximum voltage signal MAVS, a control signal CS1, and a clock pulse CKP, where the control signal CS2 is also a pulse width modulation signal, and has a duty cycle and a frequency the same as the duty cycle and the frequency of the lighting module dimming signal PWMDS. In addition, subsequent operational principles of the phase delay units 3042-3044 are the same as those of the phase delay unit 3041, so further description thereof is omitted for simplicity.

To sum up, the circuit with adjustable phase delay and a feedback voltage and the method for adjustable phase delay and a feedback voltage utilize the delay setting unit to generate a delay time according to the external resistor. Then, the phase delay signal generator can generate phase delay signals corresponding to a plurality of lighting modules according to the delay time and a lighting module dimming signal. In addition, a sample voltage generated by the sample and hold unit can overcome variation of a feedback voltage caused by the minimum voltage selection unit due to different number of turning-on lighting modules of the plurality of lighting modules and different number of the plurality of lighting modules to make the lighting module driving circuit be capable of providing a proper output voltage to the plurality of lighting modules. Therefore, the present has advantages as follows: first, because the present invention can make the lighting module driving circuit be capable of providing the proper output voltage to the plurality of lighting modules, the plurality of lighting modules do not exhibit flickers and luminance variation when the plurality of lighting modules are dimmed; second, because the delay setting unit generates the delay time according to the external resistor, a user can adjust the delay time according to a practical requirement (e.g. reaction time of a thin film transistor liquid crystal display panel); and third, because the phase delay signal generator can generate the phase delay signals corresponding to the plurality of lighting modules according to the delay time and the lighting module dimming signal, the present invention does not need a system to provide a plurality of lighting module dimming signals, and not also need a microprocessor, resulting in the present invention having lower cost. Therefore, the present invention can be applied to backlight modules, lighting modules of lighting equipments, and other light sources needing phase delay.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A circuit with adjustable phase delay and a feedback voltage, comprising:

a delay setting unit for coupling to an external resistor, wherein the delay setting unit generates a delay time according to the external resistor; and a phase delay signal generator coupled to the delay setting unit and comprising a plurality of phase delay units, wherein each phase delay unit corresponds to a lighting module, the phase delay unit comprising:

an edge trigger subunit for receiving an input signal, and generating a positive edge trigger signal and a negative edge trigger signal according to a positive edge and a negative edge of the input signal, respectively; and a signal generation subunit coupled to the edge trigger subunit for generating and outputting a phase delay signal according to the positive edge trigger signal, the negative edge trigger signal, and the delay time, wherein the phase delay signal lags the input signal for the delay time.

2. The circuit of claim 1, wherein a first phase delay unit of the plurality of phase delay units is used for receiving a lighting module dimming signal, and an input signal received by an $N^{th}$ phase delay unit is a phase delay signal outputted by an $(N-1)^{th}$ phase delay unit, wherein N is a positive integer greater than 1.

3. The circuit of claim 2, wherein the lighting module dimming signal, the input signal, and the phase delay signal are pulse width modulation signals.

4. The circuit of claim 2, wherein the lighting module dimming signal, the input signal, and the phase delay signal have the same duty cycle and the same frequency.

5. The circuit of claim 1, further comprising:

a minimum voltage selection unit coupled to one terminal of each lighting module of a plurality of lighting modules corresponding to the plurality of phase delay units for generating a minimum voltage signal according to a voltage of one terminal of each lighting module of the plurality of lighting module and a positive edge of each phase delay signal.

6. The circuit of claim 5, further comprising:

a sample and hold unit coupled to the minimum voltage selection unit for generating a sample voltage according to a combination of a voltage of one terminal of each turning-on lighting module of the plurality of lighting module and a positive edge of each phase delay signal.

7. The circuit of claim 6, further comprising:

a maximum voltage selection unit coupled to the sample and hold unit and the minimum voltage selection unit for generating a maximum voltage signal according to the minimum voltage signal and the sample voltage, wherein the maximum voltage signal is used for generating a control signal of a power switch of a primary side of a lighting module driving circuit.

8. The circuit of claim 7, wherein the control signal is a pulse width modulation signal.

9. The circuit of claim 7, wherein the maximum voltage selection unit, the sample and hold unit, the minimum voltage selection unit, the delay setting unit, and the phase delay signal generator are formed on a monolithic integrated circuit chip.

10. The circuit of claim 1, wherein the lighting module is a light-emitting diode chain.

11. A method for adjustable phase delay and a feedback voltage, wherein a circuit with the adjustable phase delay and the feedback voltage comprises a delay setting unit and a phase delay signal generator, and the phase delay signal generator comprises a plurality of phase delay units, wherein each phase delay unit corresponds to a lighting module and comprises an edge trigger subunit and a signal generation subunit, the method comprising:

the edge trigger subunit receiving an input signal, and generating a positive edge trigger signal and a negative edge trigger signal according to a positive edge and a negative edge of the input signal, respectively;

the delay setting unit generating a delay time according to an external resistor; and the signal generation subunit generating and outputting a phase delay signal according to the positive edge trigger signal, the negative edge trigger signal, and the delay time;

wherein the phase delay signal lags the input signal for the delay time.

12. The method of claim 11, wherein a first phase delay unit of the plurality of phase delay units is used for receiving a lighting module dimming signal, and an input signal received by an $N^{th}$ phase delay unit is a phase delay signal outputted by an $(N-1)^{th}$ phase delay unit, wherein N is a positive integer greater than 1.

13. The method of claim 12, wherein the lighting module dimming signal, the input signal, and the phase delay signal are pulse width modulation signals.

14. The method of claim 12, wherein the lighting module dimming signal, the input signal, and the phase delay signal have the same duty cycle and the same frequency.

15. The method of claim 11, further comprising:

generating a minimum voltage signal according to a voltage of one terminal of each lighting module of a plurality of lighting module and a positive edge of each phase delay signal.

16. The method of claim 15, further comprising:

generating a sample voltage according to a combination of a voltage of one terminal of each turning-on lighting module of the plurality of lighting module and a positive edge of each phase delay signal.

17. The method of claim 16, further comprising:

generating a maximum voltage signal according to the minimum voltage signal and the sample voltage; and generating a control signal of a power switch of a primary side of a lighting module driving circuit according to the maximum voltage signal.

18. The method of claim 17, wherein the control signal is a pulse width modulation signal.

19. The circuit of claim 11, wherein the lighting module is a light-emitting diode chain.

* * * * *